US007874443B2

(12) United States Patent
Schütz

(10) Patent No.: US 7,874,443 B2
(45) Date of Patent: Jan. 25, 2011

(54) PLASTIC TANK FOR LIQUIDS

(75) Inventor: Udo Schütz, Selters/Westerwald (DE)

(73) Assignee: Protechna S.A., Fribourg (CH)

( * ) Notice: Subject to any disclaimer, the term of this patent is extended or adjusted under 35 U.S.C. 154(b) by 0 days.

(21) Appl. No.: 11/203,665

(22) Filed: Aug. 12, 2005

(65) Prior Publication Data

US 2006/0032854 A1 Feb. 16, 2006

(30) Foreign Application Priority Data

Aug. 14, 2004 (DE) ..... 10 2004 039 482

(51) Int. Cl.
*B65D 88/00* (2006.01)

(52) U.S. Cl. ..... 220/1.5; 220/652; 220/4.12

(58) Field of Classification Search ..... 220/562, 220/563, 652, 1.5, 4.13, 675, 23.91, 4.12; 215/376, 382, 383

See application file for complete search history.

(56) References Cited

U.S. PATENT DOCUMENTS 2,457,842 A * 1/1949 Smith et al. ..... 220/1.5
2,648,428 A * 8/1953 White et al. ..... 206/386
3,179,323 A * 4/1965 Miller ..... 220/23.87
3,261,505 A * 7/1966 Swenck ..... 222/83
3,692,203 A * 9/1972 Byrd et al. ..... 220/1.5
4,173,288 A * 11/1979 Schutz ..... 220/1.5
4,505,402 A * 3/1985 Gerhard ..... 220/1.5
4,648,521 A * 3/1987 Thomas et al. ..... 220/1.5
D305,353 S * 1/1990 Thomas ..... D23/202
4,909,387 A * 3/1990 Schutz ..... 206/386
4,930,661 A * 6/1990 Voorhies ..... 206/386
D313,687 S * 1/1991 Cheval et al. ..... D3/272
D316,320 S * 4/1991 Roser ..... D3/272
5,467,884 A * 11/1995 Schutz ..... 220/1.5
5,680,955 A * 10/1997 Schutz ..... 220/1.6
5,738,240 A * 4/1998 Vavra et al. ..... 220/1.5
D394,302 S * 5/1998 Harris et al. ..... D23/202
5,794,818 A * 8/1998 Bromwell et al. ..... 222/105
5,911,337 A * 6/1999 Bedeker ..... 220/562
6,082,934 A * 7/2000 Reinsch et al. ..... 406/38
6,360,907 B1 * 3/2002 Przytulla ..... 220/23.91
6,772,912 B1 * 8/2004 Schall et al. ..... 222/143
7,036,662 B2 * 5/2006 Schutz ..... 206/386
7,108,133 B2 * 9/2006 Przytulla ..... 206/386
7,159,718 B2 * 1/2007 Cassina ..... 206/524.3
7,275,651 B2 * 10/2007 Morales et al. ..... 220/203.23
2003/0006235 A1 * 1/2003 Przytulla ..... 220/485
2004/0011785 A1 * 1/2004 Van Der Heijden et al. 220/4.13

FOREIGN PATENT DOCUMENTS

DE 103 01 517 3/2004

* cited by examiner

*Primary Examiner*—Anthony Stashick
*Assistant Examiner*—Christopher B McKinley
(74) *Attorney, Agent, or Firm*—Lucas & Mercanti, LLP; Klaus P. Stoffel

(57) ABSTRACT

A plastic tank for liquids formed as a rectangular-solid or cubic container has four sidewalls, an upper base with a filling socket, a lower base, and an outlet socket, the outlet socket being formed on the lower section of a sidewall for connection to a tapping valve. The upper corner regions between the sidewalls and the upper base of the container and/or the lower corner regions between the sidewalls and the lower base of the container have at least one indentation or projection each.

2 Claims, 4 Drawing Sheets

PLASTIC TANK FOR LIQUIDS

BACKGROUND OF THE INVENTION

1. Field of the Invention

The present invention relates to a plastic tank for liquids, which is formed as a rectangular-solid or cubic tank with four sidewalls, an upper base with a closable filling socket, a lower base, and an outlet socket, which is formed on the lower section of a sidewall for connection to a tapping valve.

2. Description of the Related Art

During the shipment of liquids in liquid tanks of this general type, which are described in DE 103 01 517 B3 and used as inner tanks of pallet tanks, the sidewalls and the upper and lower bases of the tank are subject to variable internal pressure stresses due to "sloshing" of the liquid in the inner tank, which is caused by the startup, acceleration, and braking of the transport vehicle and by driving vibrations transmitted by the chassis. The four upper corner regions, in which the rounded vertical edge between two adjacent sidewalls and the two rounded horizontal edges between the upper base and the adjacent sidewalls meet, are especially subject to high stresses, since the internal pressure forces acting on the sidewalls are superimposed on those acting on the upper base in these corner regions. Due to the variable internal pressure stress and the oscillatory motion that it produces in the sidewalls and upper base of the tank, the danger exists, especially in the upper corner regions of the plastic tank, that cracks will develop, through which liquid can leak from the tank, so that safe shipment of the liquid tank is no longer guaranteed.

SUMMARY OF THE INVENTION

The object of the invention is to improve the shipping safety of liquid tanks of this general type.

In accordance with the invention, this object is met by a liquid tank in which the upper corner regions between the sidewalls and the upper base of the liquid tank and/or the lower corner regions between the sidewalls and the lower base of the tank have at least one indentation or projection each.

As a result of the formation, in accordance with the invention, of indentations and/or projections in the upper corner regions between the sidewalls and the upper base and possibly in the lower corner regions between the sidewalls and the lower base of this general type of liquid tank, the corner regions of the tank are reinforced and uncoupled from the dynamic internal pressure stresses that act on the sidewalls and the upper base during the shipment of liquids. Crack formation in the corner regions of the tank is prevented in this way.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE INVENTION

Figure 1:
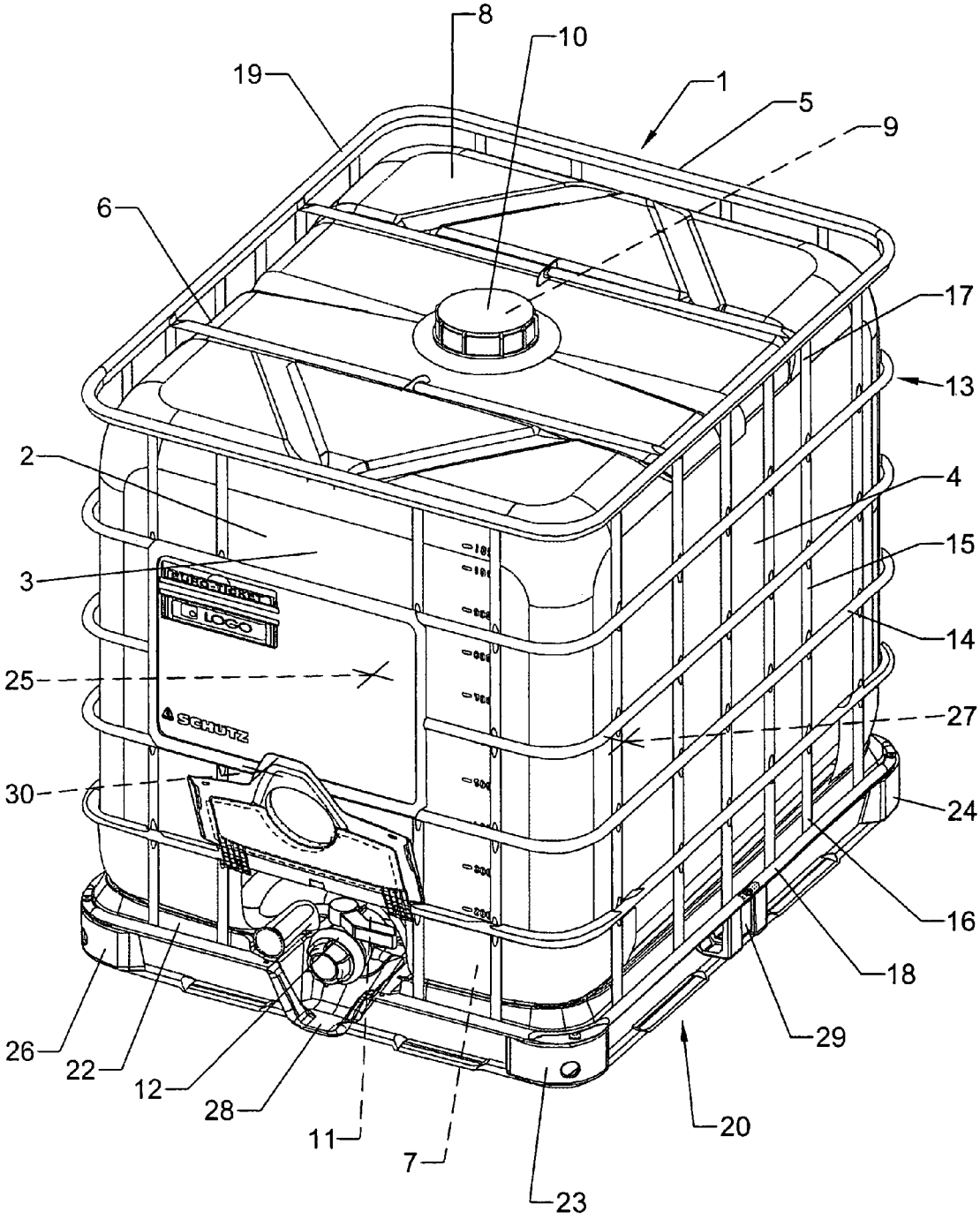
FIG. 1 is perspective view of a shipping and storage tank for liquids.

The shipping and storage tank 1 for liquids, which is used as a disposable and reusable tank, has as its principal components a replaceable rectangular-solid plastic inner tank 2 with four sidewalls 3-6, a lower base 7 designed as a draining base and an upper base 8, a filling socket 9 that is formed on the upper base 8 and can be closed with a cap 10, and an outlet socket 11 formed on the lower section of a sidewall 3 for connection to a tapping valve 12. The shipping and storage tank 1 also has an outer cage 13 made of intersecting horizontal and vertical metal bars 14, 15 for holding the inner tank 2. The ends 16, 17 of the vertical cage bars 15 are welded to a lower and an upper peripheral edge profile 18, 19 of the cage 13. In addition, the shipping and storage tank 1 has a pallet-like support frame 20 with standard European length and width dimensions. The lower base 7 of the inner tank 2 conforms to and stands on the base 22 of the support frame 20.

The base 22 of the support frame 20, which is designed for handling by means of stacker trucks, rack trucks, and similar types of moving equipment, rests on four corner feet 23-26, a rear center foot 27, a front center foot 28, which is formed out of the base 22 and is located below the tapping valve 12 of the shipping tank 1, and on two lateral center feet 29, 30, which are formed by the outer ends of a bridge-like reinforcement plate for the base 22.

The vertical edges 32-35 between adjacent sidewalls 3-6, the horizontal edges 36-39 between the upper base 8 and the four sidewalls 3-6, and the horizontal edges 40-43 between the lower base 7 and the four sidewalls 3-6 of the inner tank 2 are rounded, and the four upper corner regions 44-47 between the sidewalls 3-6 and the upper base 8, and the four lower corner regions 48-51 between the sidewalls 3-6 and the lower base 7 of the inner tank 2 are formed as spherical segments.

Figure 2:
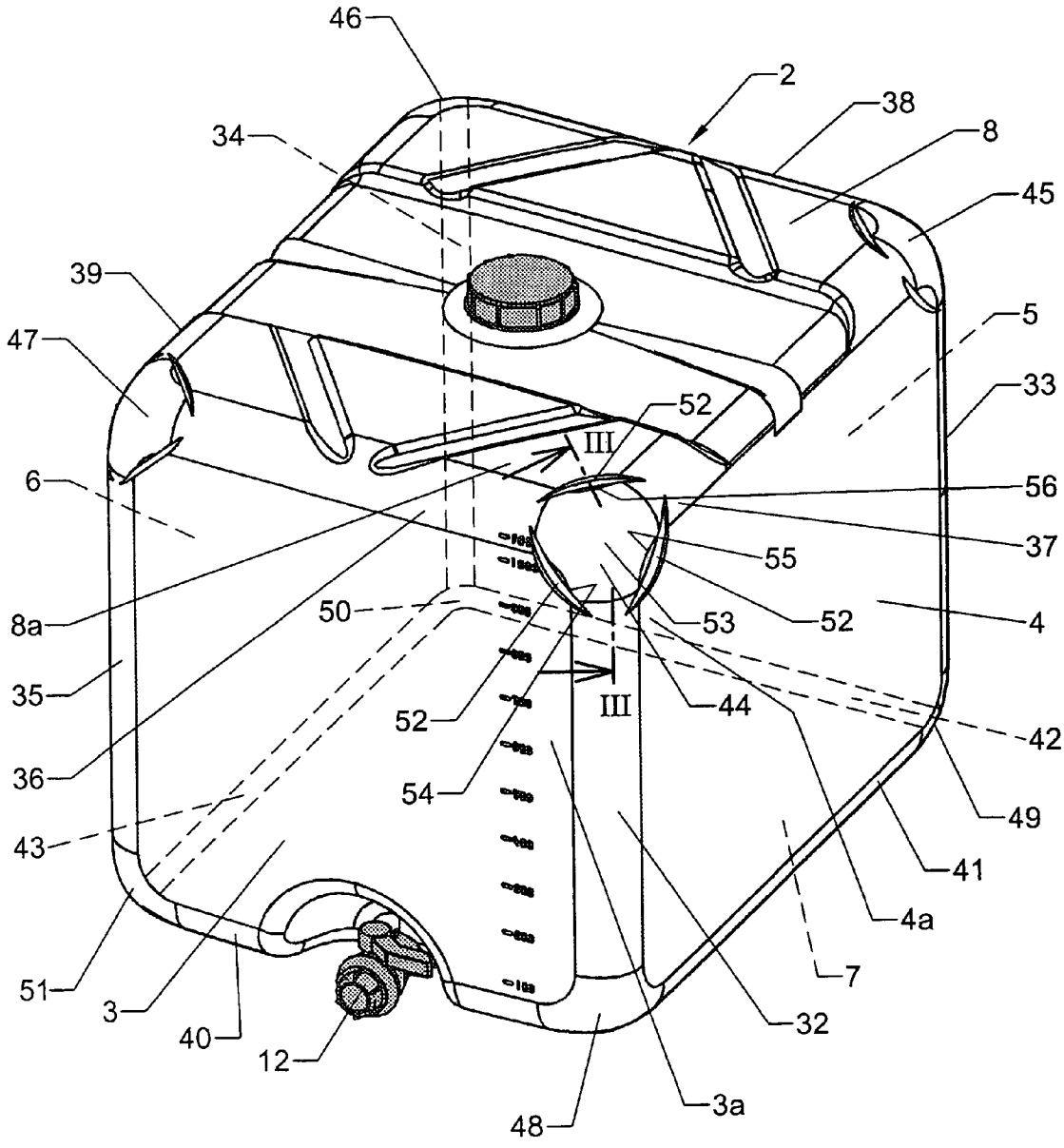
FIG. 2 is a perspective view of a first embodiment of the inner tank of the shipping and storage tank of FIG. 1.
Figure 3:
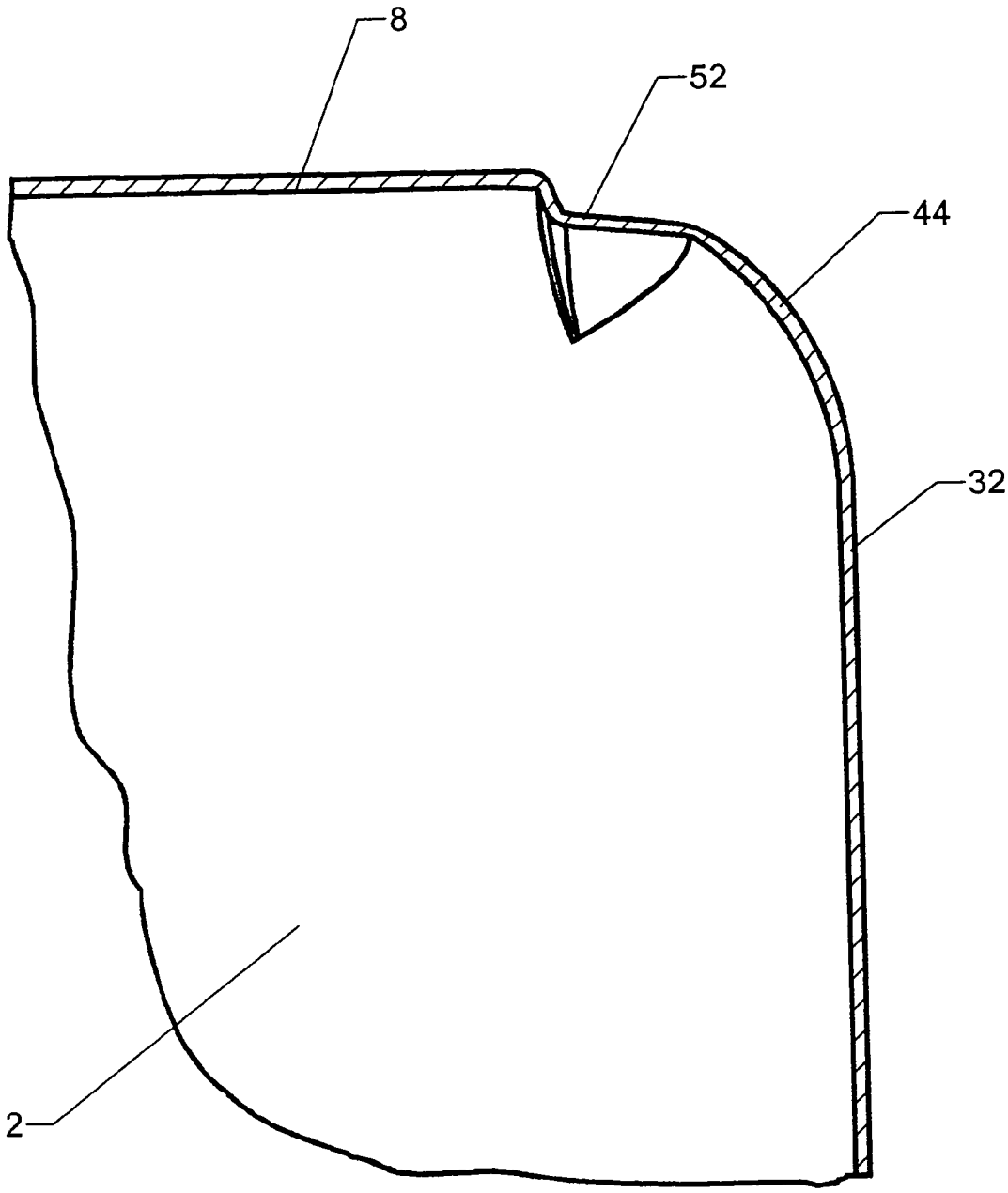
FIG. 3 is an enlarged partial cross section of the inner tank along line III-III in FIG. 2.

In the inner tank 2 (FIG. 2) of the liquid shipping and storage tank 1, the four upper corner regions 44-47 are each reinforced by three step-like indentations 52, which are arranged concentrically with respect to the center 53 of the corner regions and spaced apart from one another. The three indentations 52 of a corner region 44-47 run like secants through the rounded corners 54-56 of the two lateral wall surfaces 3*a*, 4*a* adjacent to the corner region and of the adjacent upper base surface 8*a* of the inner tank 2.

Figure 4:
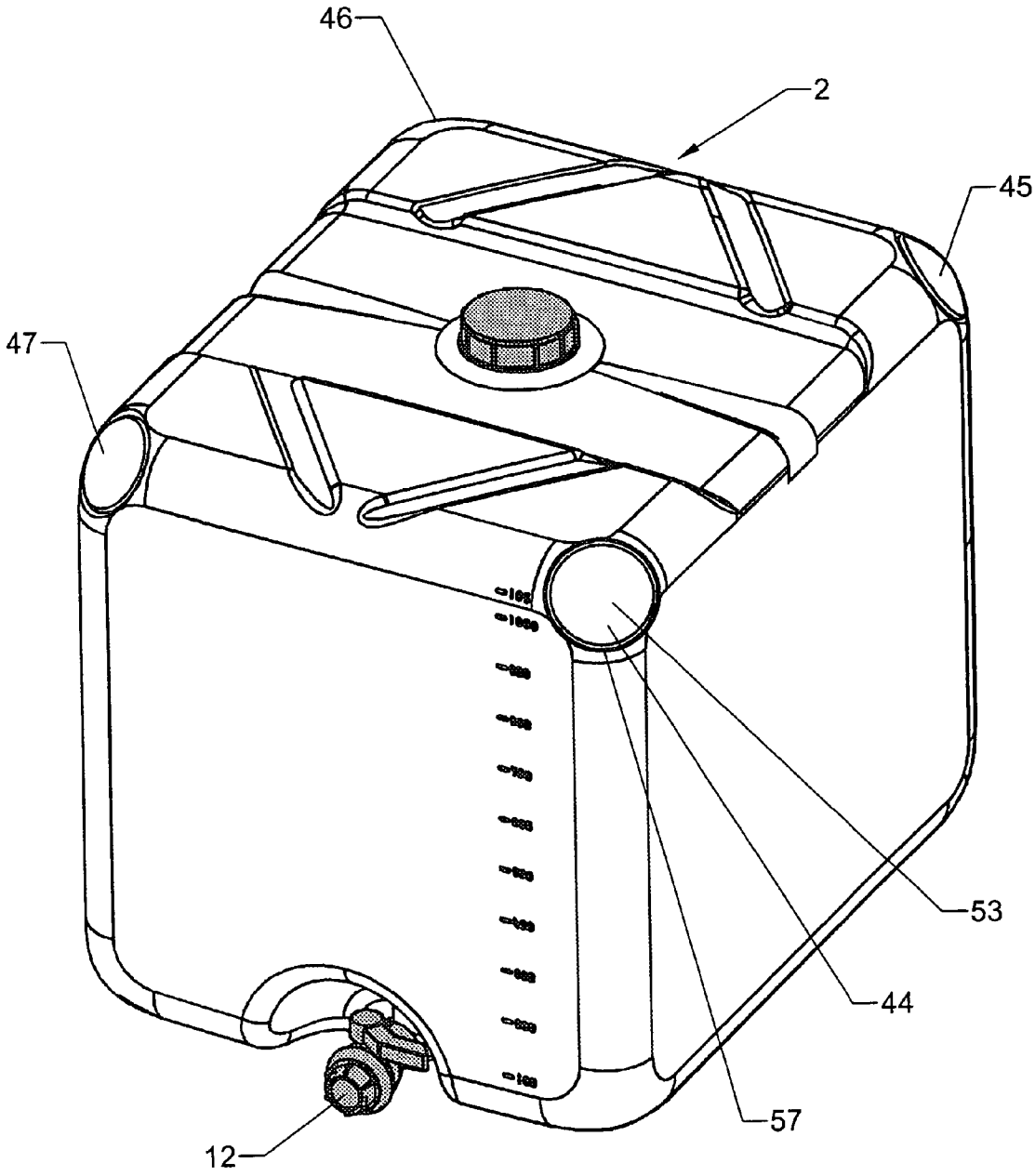
FIG. 4 is a perspective view of a second embodiment of the inner tank for the shipping and storage tank of FIG. 1.

In another embodiment (FIG. 4) of the inner tank 2 of the shipping and storage tank 1, the four upper corner regions 44-47 are each reinforced by an annular reinforcing fin 57 that is formed concentrically with respect to the centers 53 of the corner regions 44-47.

In a departure from the two embodiments of the inner tank 2 that are described above, the inner tank 2 can be additionally reinforced by step-like indentations 52 or annular reinforcing fins 57 in the lower corner regions 48-51.

The inner tank 2 of the liquid shipping and storage tank 1 with reinforced corner regions 44-47 is produced by blow molding an extruded tubular plastic parison in a blow mold.

While specific embodiments of the invention have been shown and described in detail to illustrate the inventive principles, it will be understood that the invention may be embodied otherwise without departing from such principles.

I claim:

1. A liquid container of plastic, the container being formed as a rectangular parallelpipedal or cubic container with four sidewalls, an upper base with a filling socket, a lower base, and an outlet socket, the outlet socket being formed on the lower section of a sidewall for connection of a tapping valve, wherein upper corner regions between the sidewalls and the upper base of the container and/or the lower corner regions between the sidewalls and the lower base of the container are formed as spherical segments and comprise three step-like or fin-like indentations formed in the corner regions of the container and arranged concentrically to the center of the corner regions spaced apart from one another, wherein the indentations extend like secants through the rounded corners of the two lateral wall surfaces adjacent to each corner region and of the adjacent upper or lower base surface of the container.

2. A liquid container of plastic, the container being formed as a rectangular parallelpipedal or cubic container with four sidewalls, an upper base with a filling socket, a lower base, and an outlet socket, the outlet socket being formed on the lower section of a sidewall for connection of a tapping valve, wherein upper corner regions between the sidewalls and the upper base of the container and the lower corner regions between the sidewalls and the lower base of the container are formed as spherical segments and wherein each corner region has an annular fin formed concentrically with respect to the centers of the corner regions wherein said annular fin is formed as a secant in the corner regions.

* * * * *